US008568194B2

(12) United States Patent
Fein et al.

(10) Patent No.: US 8,568,194 B2
(45) Date of Patent: Oct. 29, 2013

(54) COLLAPSIBLE TOY KITCHEN APPARATUSES AND METHODS

(75) Inventors: Jason L. Fein, Hastings on Hudson, NY (US); Gary L. Bilezkian, Warwick, NY (US)

(73) Assignee: Guidecraft Inc., Tuxedo, NY (US)

( * ) Notice: Subject to any disclaimer, the term of this patent is extended or adjusted under 35 U.S.C. 154(b) by 401 days.

(21) Appl. No.: 13/038,153

(22) Filed: Mar. 1, 2011

(65) Prior Publication Data

US 2012/0225605 A1 Sep. 6, 2012

(51) Int. Cl.
*A63H 33/30* (2006.01)

(52) U.S. Cl.
CPC ..... *A63H 33/3055* (2013.01)
USPC ..... 446/481; 446/80; 446/147; 446/148; 446/149; 446/150; 446/151; 446/152; 446/478; 446/487; 446/488

(58) Field of Classification Search
CPC ..... A63H 33/3055
USPC ..... 446/80, 147–152, 478, 481, 487, 488
See application file for complete search history.

(56) References Cited

U.S. PATENT DOCUMENTS

| | | | | | |
|---|---|---|---|---|---|
| 963,769 | A | * | 7/1910 | Johnson et al. | 220/6 |
| 1,128,031 | A | * | 2/1915 | Needleman | 446/478 |
| 1,318,229 | A | * | 10/1919 | Peters | 312/228 |
| 2,127,047 | A | * | 8/1938 | Pinney | 434/80 |
| 3,133,376 | A | * | 5/1964 | Orenstein | 446/481 |
| 3,231,942 | A | * | 2/1966 | O'Brien | 52/70 |
| 3,808,730 | A | * | 5/1974 | Cooper et al. | 446/481 |
| 3,915,529 | A | * | 10/1975 | Bernier | 312/237 |
| 3,983,583 | A | * | 10/1976 | Herman et al. | 62/331 |
| 4,190,978 | A | * | 3/1980 | Nelson | 446/478 |
| D261,159 | S | * | 10/1981 | Rapaport | D21/524 |
| 4,332,101 | A | * | 6/1982 | Tomita | 446/24 |
| 4,333,258 | A | * | 6/1982 | McCaslin | 446/130 |
| 4,467,553 | A | * | 8/1984 | Kanda | 446/136 |
| 4,515,359 | A | * | 5/1985 | Mariol | 446/481 |
| D294,608 | S | * | 3/1988 | Benedetto et al. | D21/524 |
| 4,919,109 | A | * | 4/1990 | Riley | 126/9 R |
| 4,934,280 | A | * | 6/1990 | Bae | 108/99 |
| 4,964,249 | A | * | 10/1990 | Payne | 52/70 |

(Continued)

FOREIGN PATENT DOCUMENTS

EP 1941937 7/2008

OTHER PUBLICATIONS

Guidecraft Kitchen Helper Assembly Instructions http://www.guidecraft.com/media/document/G97325KitchenHelperAls.pdf Accessed Feb. 17, 2001.

(Continued)

*Primary Examiner* — Gene Kim
*Assistant Examiner* — Alexander Niconovich
(74) *Attorney, Agent, or Firm* — Spilman Thomas & Battle, PLLC

(57) ABSTRACT

A collapsible toy kitchen apparatus and method, an embodiment including a back support including a backsplash, a kitchen counter including a countertop and a range and being pivotably connected to the back support, a base pivotably connected to the back support, and two side walls that are each foldable. The pivotable connections and foldable side walls allow the toy kitchen to collapse, such as for storage.

20 Claims, 9 Drawing Sheets

(56) References Cited

U.S. PATENT DOCUMENTS

| | | | | | |
|---|---|---|---|---|---|
| 4,974,526 | A * | 12/1990 | Wiygul, Jr. | 108/159 |
| 5,004,445 | A * | 4/1991 | Coleman et al. | 446/478 |
| 5,215,491 | A * | 6/1993 | Willet et al. | 446/176 |
| D342,121 | S * | 12/1993 | Lim | D23/286 |
| 5,313,747 | A * | 5/1994 | Sakihara | 52/64 |
| D366,293 | S * | 1/1996 | Yang | D21/524 |
| 5,664,854 | A * | 9/1997 | Letch | 312/262 |
| 5,716,253 | A * | 2/1998 | Aoki et al. | 446/14 |
| D396,072 | S * | 7/1998 | Katzman et al. | D21/524 |
| 5,971,833 | A * | 10/1999 | Rasmussen et al. | 446/478 |
| 6,048,251 | A * | 4/2000 | Klitsner et al. | 446/479 |
| 6,108,982 | A * | 8/2000 | Davison | 52/64 |
| 6,287,560 | B1 * | 9/2001 | Fujii | 434/127 |
| 6,439,957 | B1 * | 8/2002 | MacCarthy | 446/479 |
| D478,946 | S * | 8/2003 | Franta et al. | D21/524 |
| 6,607,421 | B1 * | 8/2003 | Rossi | 446/478 |
| 6,611,972 | B2 * | 9/2003 | Underbrink et al. | 4/619 |
| 6,672,659 | B1 * | 1/2004 | Melohn et al. | 297/118 |
| 6,719,603 | B2 * | 4/2004 | Chan | 446/175 |
| 6,817,046 | B1 * | 11/2004 | Srour et al. | 5/99.1 |
| 6,883,881 | B2 * | 4/2005 | Gauss | 312/237 |
| 6,964,595 | B2 * | 11/2005 | Libretti | 446/482 |
| 7,094,126 | B1 * | 8/2006 | Lenihan | 446/481 |
| 7,121,274 | B2 * | 10/2006 | Wishart | 126/57 |
| D531,680 | S * | 11/2006 | Lo | D21/524 |
| 7,387,560 | B2 * | 6/2008 | Brumagin et al. | 446/481 |
| 7,552,563 | B2 * | 6/2009 | Becker | 52/79.5 |
| 7,901,018 | B2 * | 3/2011 | Baughman | 312/240 |
| 2003/0027482 | A1 * | 2/2003 | Dumigan et al. | 446/74 |
| 2003/0153238 | A1 * | 8/2003 | Chan | 446/175 |
| 2006/0030235 | A1 * | 2/2006 | Brumagin et al. | 446/175 |
| 2008/0096463 | A1 * | 4/2008 | Wojtkiewicz et al. | 446/481 |

OTHER PUBLICATIONS

Guidecraft Kitchen Helper web page http://www.guidecraft.com/product/297131/G97325/_/KITCHEN_HELPER Accessed Mar. 16, 2011.

Images of Momoll "Lili" wooden play kitchen http://www.spunkysprout.com/plli.html Accessed Mar. 18, 2011.

* cited by examiner

COLLAPSIBLE TOY KITCHEN APPARATUSES AND METHODS

FIELD OF THE INVENTION

This invention is related to toys, and more particularly to toy kitchens that may be collapsed, such as for storage.

BACKGROUND OF THE INVENTION

Toy kitchens consume significant space. Because of their size, many toy kitchens cannot be stored as assembled in narrow or small areas, such as under beds or in some closets. Therefore, the toy kitchens may have to be partially disassembled into parts small enough to store in those areas. However, such disassembly (and subsequent assembly) may be time-consuming and parts of the toy kitchen may be lost during the storage process.

Therefore, there may be a need for a toy kitchen that may be quickly collapsed for storage in narrow or small areas without removal of numerous parts. There may also be a need for a toy kitchen that may likewise be quickly reassembled to its expanded position for use.

SUMMARY OF THE INVENTION

In an embodiment, a collapsible toy kitchen includes: a back support including a backsplash; a kitchen counter including a countertop and a range, the kitchen counter pivotably connected to the back support; a base, the base pivotably connected to the back support; two side walls that are each foldable; and a fastener, the kitchen counter securable to the back support with the fastener.

In another embodiment, the collapsible toy kitchen includes: a back support including a backsplash; a kitchen counter including a countertop and a lip, the lip including a first aperture; a shelf extending from the back support and including a second aperture; and a fastener to secure the kitchen counter to the shelf by extending at least partially through both the first aperture and the second aperture.

Other embodiments, which may include one or more parts of the aforementioned method or systems or other parts, are also contemplated, and may thus have a broader or different scope than the aforementioned method and systems. Thus, the embodiments in this Summary of the Invention are mere examples, and are not intended to limit or define the scope of the invention or claims.

BRIEF DESCRIPTION OF THE DRAWINGS

The accompanying drawings, wherein like reference numerals are employed to designate like components, are included to provide a further understanding of collapsible toy kitchens and methods, are incorporated in and constitute a part of this specification, and illustrate embodiments of collapsible toy kitchens and methods that together with the description serve to explain the principles of collapsible toy kitchens and methods.

Various other objects, features and advantages of the invention will be readily apparent according to the following description exemplified by the drawings, which are shown by way of example only, wherein.

DETAILED DESCRIPTION

Figure 1:
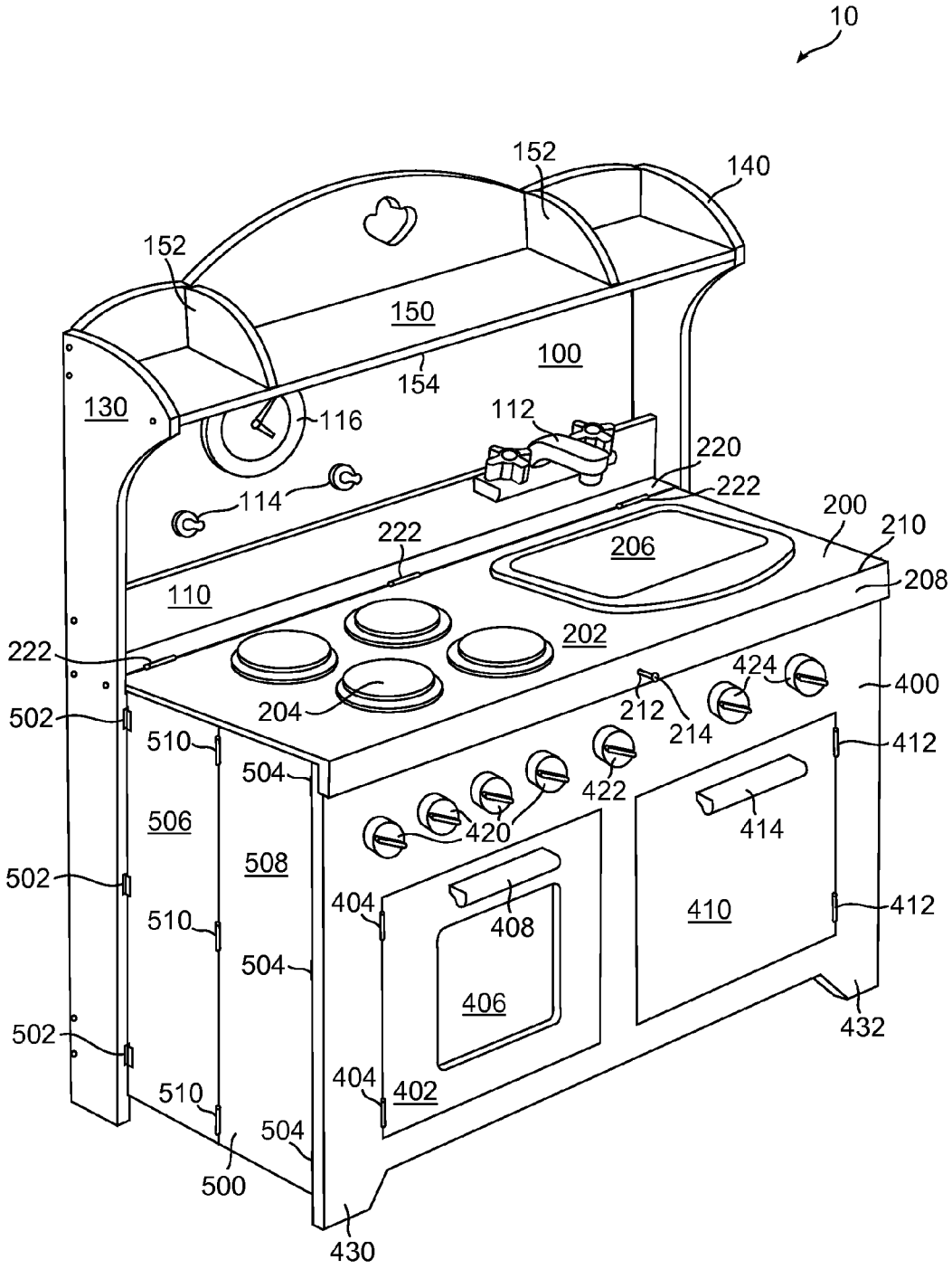
FIG. 1 illustrates a perspective view of a collapsible toy kitchen, in accordance with one embodiment.
Figure 2:
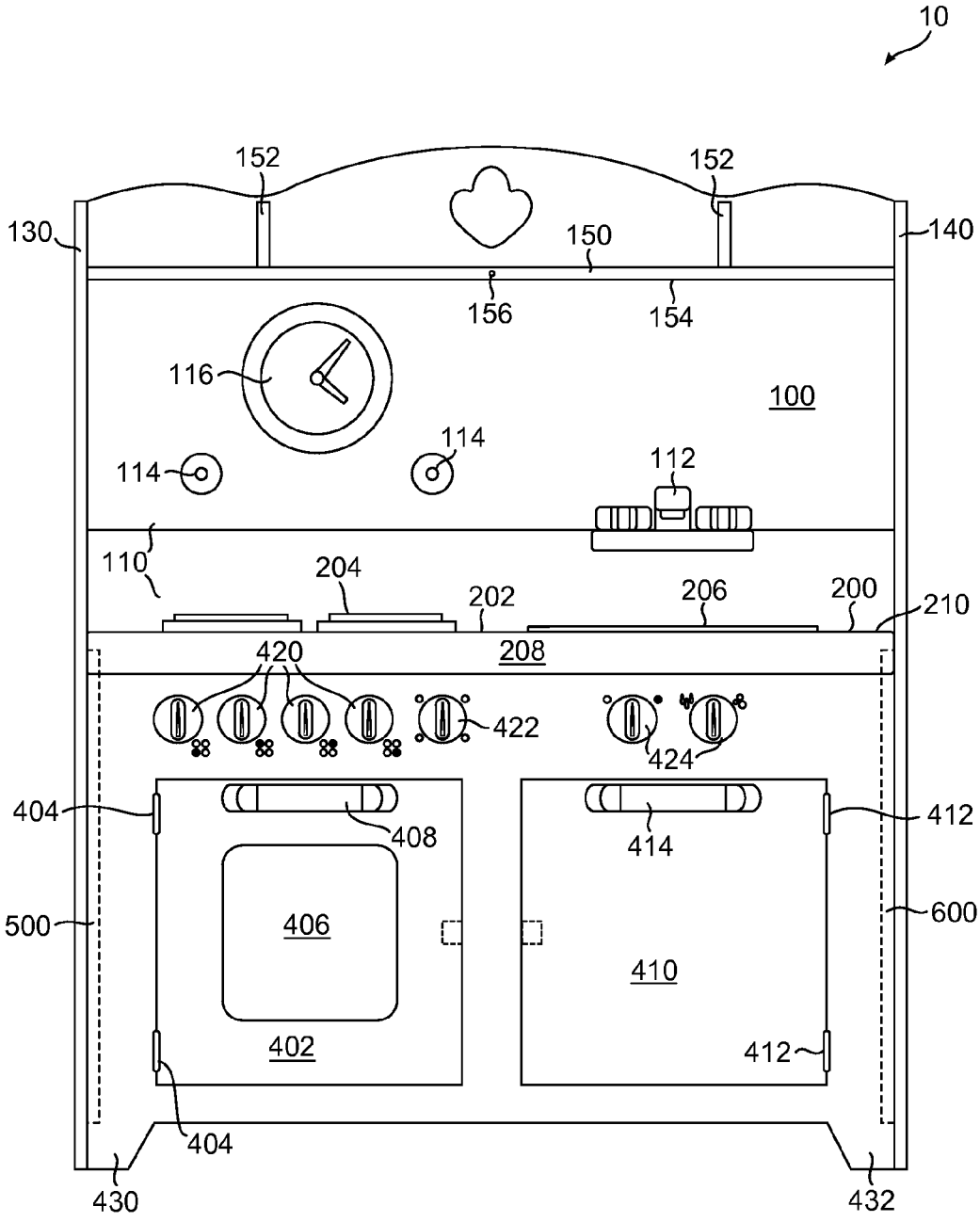
FIG. 2 illustrates a front view of a collapsible toy kitchen, in accordance with one embodiment.

Reference will now be made to embodiments of collapsible toy kitchens and methods, examples of which are illustrated in the accompanying drawings. Details, features, and advantages of the collapsible toy kitchens and methods will become further apparent in the following detailed description of embodiments thereof.

As used herein, to "pivot" means to turn about an axis. The axis may be defined, for example, by a pin or bolt to which the thing that pivots is connected. When a first thing is "pivotably connected" to another, the first thing is connected in such a way, e.g., by a pin or bolt, that allows that first thing to pivot relative to the other. Being "pivotably connected" does not necessarily mean that the first thing can freely pivot about the other thing at all times. Rather, a locking device (e.g., fastener 214 securing kitchen counter 200 to front wall 400 or shelf 150; latch 610 with its bar 612 resting against its catch 616) may be installed and thereby prevent pivoting and have to be removed or unlatched or otherwise adjusted, for example, to allow the pivoting.

Additionally, being "pivotably connected" does not necessarily mean that the first thing is pivotable about the second thing directly about the point or area of connection. Rather, the first thing may be "pivotably connected" to the second via an attachment that is not itself pivotable but allows the first thing to pivot with respect to the second thing (e.g., kitchen counter 200 may be connected to the back support 100 via a nonpivoting attachment that is the connecting board 220, but may pivot about hinges 222 attached to the connecting board 220 and thus be pivotable with respect to back support 100).

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment.

References to "or" are furthermore intended as inclusive, so "or" may indicate one or another of the ored terms or more than one ored term.

FIGS. 1 through 4 illustrates a perspective view, front view, side view, and top view, respectively, of a collapsible toy kitchen 10, in accordance with embodiments. Slight design differences are shown between FIG. 1 and FIGS. 2 to 4. The collapsible toy kitchen 10 is shown in FIGS. 1 through 4 in the expanded position, for use. The collapsible toy kitchen 10 may include a back support 100, a kitchen counter 200, and a base 300 (the base 300 is hidden in FIGS. 1 through 4, but is shown, for example, in FIGS. 5 and 8 described below). The collapsible toy kitchen 10 may further include a front wall 400 and two side walls 500 and 600.

The back support 100 may include a backsplash 110 and, as shown, for example, in FIGS. 5 and 7-9 described below, a lower back wall 120. The back support 100 may be one piece such that the backsplash 110 and lower back wall 120 are integral. In another embodiment, the backsplash 110 and lower back wall 120 may be formed of a combined two or more pieces, such as the two pieces forming the backsplash 110 and an additional piece forming the lower back wall 120 as shown in the figures. The backsplash 110 may include a wall or portion of a wall and may have various elements attached thereto, such as described herein.

The collapsible toy kitchen 10 may include one or more kitchen components and/or accessories attached to the back support 100. For example, a faucet 112, hooks 114 such as for hanging pots or dishrags, and a clock 116 may be secured to the backsplash 100 of the back support 100. The faucet 112 and clock 116, as well as other elements of the toy kitchen may be considered toys and thus not "work" as their real counterparts, though in an embodiment one or more of those elements may work.

In another embodiment, the back support 100 may include further pieces, such as braces 130 and 140, to provide further structural support to the collapsible toy kitchen 10. The braces 130 and 140 may form sides of the back support 100. The braces 130 and 140 may also serve as legs that will, along with the front legs 430 and 432 of the front wall 400 described below, support the collapsible toy kitchen 10 against the ground.

The back support 100 may further include a shelf 150. The shelf 150 may extend from the backsplash 110. The shelf 150 may include one or more partitions 152 if desired. The shelf 150 may include a hole or other aperture therein, such as the aperture 156 shown by hidden lines in FIGS. 2-4 and 10, in which to receive the fastener 214 such as described below. The underside 154 of the shelf 150 may include the aperture 156 in an embodiment. Thus, the aperture 156 may extend partway into the shelf 150 through the underside 154 or may extend completely through the shelf 150, as desired. The aperture 156 may be at least partially threaded in an embodiment in which the fastener 214 is at least partially threaded to secure the fastener 214 at least partially therein via the threading of the aperture 156 and fastener 214.

The kitchen counter 200 may include a countertop 202 and one or more kitchen components. The kitchen components may be positioned on and/or extend through the countertop 202. In an embodiment, the kitchen counter 200 includes the countertop 202, a range 204 secured to the countertop 202, and a sink 206 extending through the countertop 202. The range 204 may be secured to the countertop 202 by being integral therewith or may be attached with an adhesive or other means. The sink 206 may be integral with the countertop 202 or at least partially rest on the countertop 202 while extending through the countertop 202.

The kitchen counter 200 may include a lip 208. The lip 208 may extend from the front edge 210 of the kitchen counter 200. In an embodiment, the countertop 202 is approximately flat and the lip 208 extends approximately perpendicularly to the countertop 202, though the lip 208 may extend at another angle if desired. The lip 208 may include an aperture 212, through which a fastener 214 described below may extend to secure the kitchen counter 200 to the front wall 400 as described below.

The kitchen counter 200 may be pivotably connected to the backsplash 110 or other part of the back support 100, as desired. In one such embodiment, the kitchen counter 200 is pivotably connected to the back support 100 via an attachment, which is a connecting board 220. The connecting board 220 may be attached to the backsplash 110 of the back support 100, such as by screws or other means. The kitchen counter 200 may be connected to the connecting board 220 via one or more hinges 222, allowing the kitchen counter 200 to pivot with respect to the back support 100.

The kitchen counter 200 may be securable to the back support 100 with the fastener 214. In an embodiment, the kitchen counter 200 is securable to the shelf 150 of the back support 100. The kitchen counter 200 may pivot (if the fastener 214 is removed) such that its front edge 210 and lip 208 rotates toward the back support 100 till the aperture 212 of the lip 208 is aligned with the aperture 156 of the shelf 150. The fastener 214 may then be extended through the aperture 212 of the lip 208 and into the aperture 156 on the underside 154 of the shelf 150 to secure the kitchen counter 200 to the back support 100 by securing the kitchen counter 200 to the shelf 150. As described above, the fastener 214 and aperture 156 of the shelf 150 may each be at least partially threaded such that the fastener 214 may be secured at least partially in the aperture 156 to secure the kitchen counter 200 to the shelf 150 such as shown in FIGS. 7-10. As such, the kitchen counter 200 may be secured in the upright, or its collapsed, position, and thus the position when the collapsible toy kitchen 10 is collapsed as described below.

As described above, the aperture 156 may extend completely through the shelf 150, as desired. In that embodiment, the kitchen counter 200 may be securable to the shelf 150 with the fastener 214 either extending first through the kitchen counter 200, such as through the aperture 212 of the lip 208, and then through the aperture 156 at the underside 154 of the shelf, or may alternatively extend first through the other side of the shelf 150 and then into the kitchen counter 200. In the latter case, the aperture 212 of the lip 208 may be partially threaded if the fastener 214 is a threaded bolt, though the aperture 212 may be at least partially threaded in the other embodiments herein, if desired.

Figure 10:
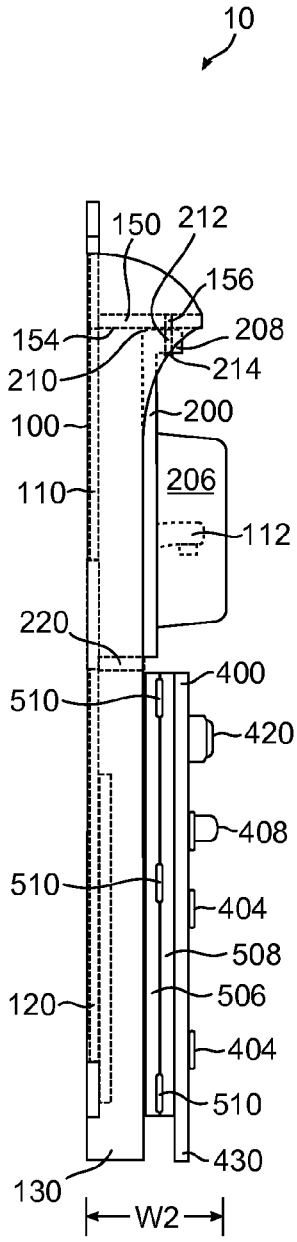
FIG. 10 illustrates a side view of the collapsible toy kitchen in the fully collapsed position, in accordance with one embodiment.

In an embodiment, the faucet 112 is secured to the back support 100, and more particularly the backsplash 110, in a position such that when the kitchen counter 200 is secured to the shelf 150 with the fastener 214, the faucet 112 extends at least partially into the sink 206, meaning that the faucet 112 (which includes a spout and may or may not include knobs) extends at least partially into the volume contained by the sink 206, such as shown in FIG. 10 described below.

Figure 5:
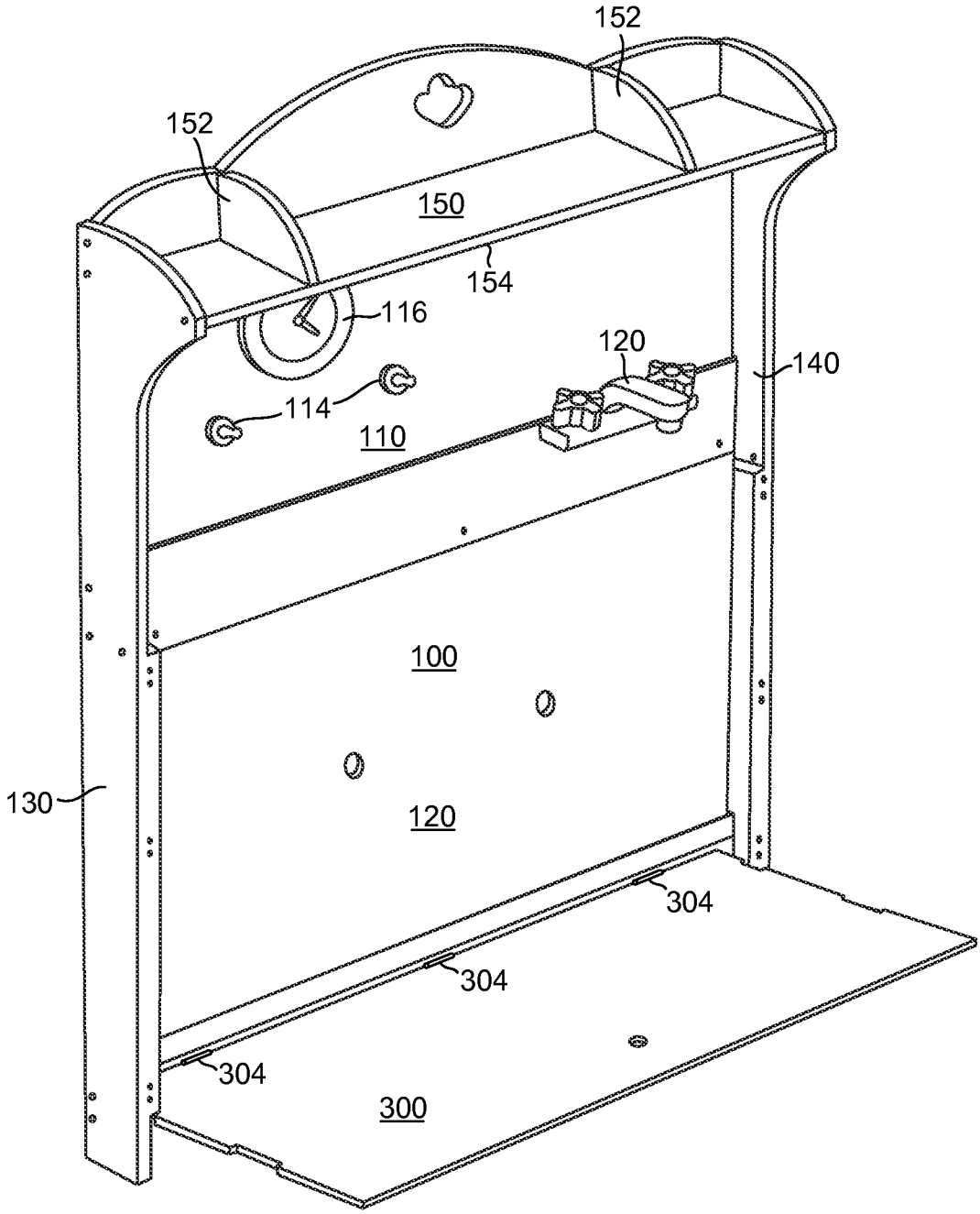
FIG. 5 illustrates a perspective view of part of a collapsible toy kitchen, in accordance with one embodiment.
Figure 8A:
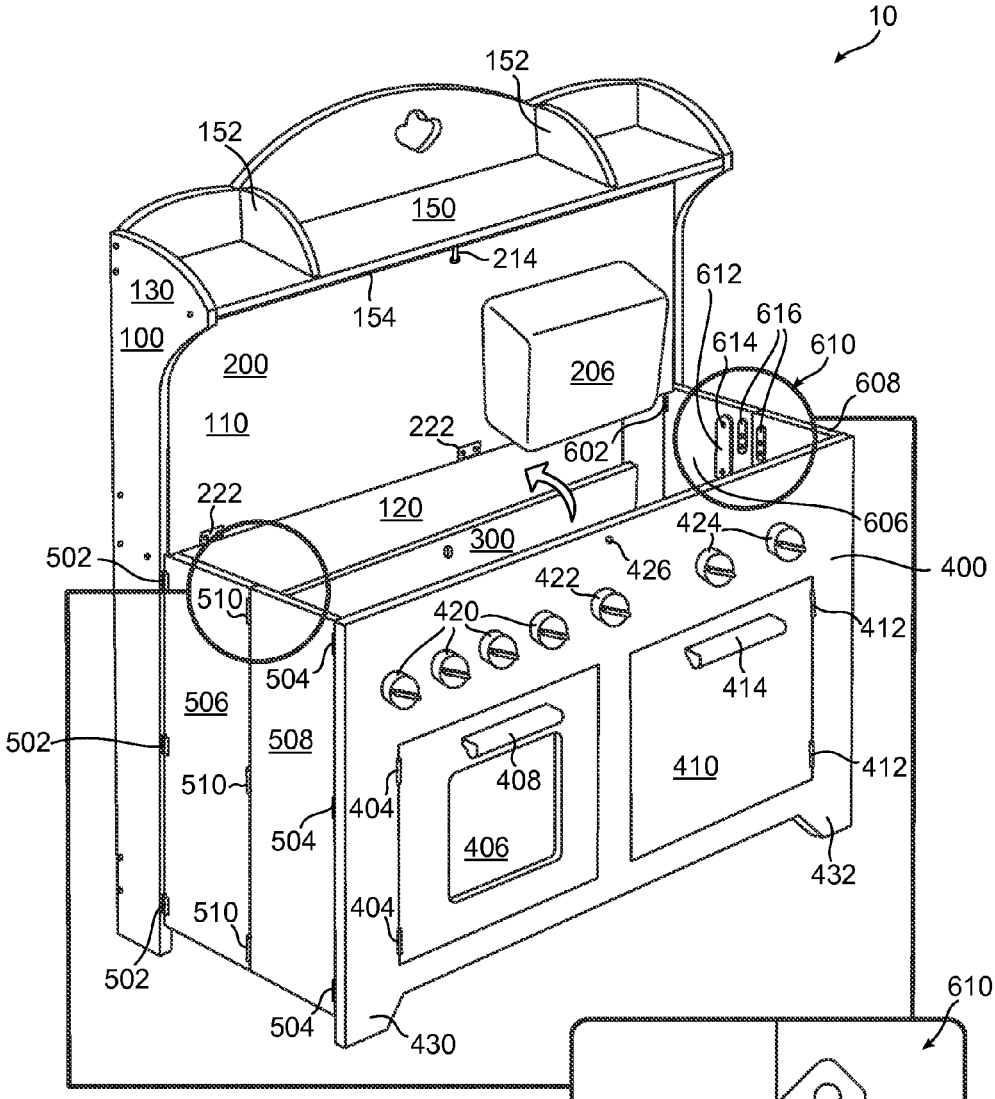
FIG. 8*a* illustrates a perspective view of the collapsible toy kitchen with the kitchen counter and base in the collapsed position, in accordance with one embodiment.

The base 300, shown in FIG. 5, which illustrates a perspective view of part of the collapsible toy kitchen 10 so the base 300 can be seen, and also partially shown in FIG. 8*a*, may be a flooring for the collapsible kitchen toy 10. The flooring may be for a play oven and dishwasher respectively adjacent and inside the oven door 402 and dishwasher doors 410 described below with respect to the front wall 400. The base 300 may be pivotably connected to the lower back wall 120 or another portion of the back support 100. In an embodiment, the base 300 is pivotably connected to the back support 100 via an attachment, which is a connecting board 302. The connecting board 302 may be attached to the lower back wall 120 of the back support 100, such as by screws or other means. The kitchen counter 200 may be connected to the connecting board 302 via one or more hinges 304, allowing the base 300 to pivot with respect to the back support 100.

As pivotably connected to the back support 100, the base 300 may be able to pivot upward to a position such as shown in FIG. 8*a* as part of the process of collapsing the collapsible toy kitchen 10, as described below.

Returning to FIGS. 1 through 4, the front wall 400 may have an oven door 402 connected thereto, and may be pivotably connected thereto via hinges 404 if desired. The oven door 402 may be a door that includes a window 406 and handle 408. A dishwasher door 410 may be connected to the front wall 400 as well, and may be pivtoably attached thereto via hinges 412 if desired. The dishwasher door 410 may include a handle 414. The oven door 402 and dishwasher door 410 may open to an interior compartment, which may be the volume surrounded by the lower back wall 120 (shown in, e.g., FIG. 5), kitchen counter 200, base 300, front wall 400, and the side walls 500 and 600 described below.

The front wall 400 may have controls 420, 422, and 424 connected thereto. The controls 420, 422, and 424 may be rotatable knobs or other controls designed to look like controls for the range 204, an oven (the part of the aforementioned interior compartment adjacent the oven door 402), and a dishwasher (the part of the interior compartment adjacent the dishwasher door). For example, the four controls 420 may be play controls each corresponding to one of the burners of the range 204. The control 422 may be a play control for the oven. The controls 424 may be play controls for the dishwasher. The number of total controls and number of controls assigned to each of the range 204, oven, and dishwasher may vary as desired.

The front wall 400 may include an aperture 426, such as shown in FIGS. 3-4 and 7-9, to receive the fastener 214 to secure the kitchen counter 200 to the front wall 400. Thus, the fastener 214 may extend through the aperture 212 of the kitchen counter 200 and further extend into the aperture 426 of the front wall 400 to secure the kitchen counter 200 to the front wall 400. The aperture 426 may be at least partially threaded in an embodiment in which the fastener 214 is at least partially threaded such that the fastener 214 can screw into the aperture 426.

The front door 400 may include feet 430 and 432, which may, along with the braces 130 and 140 of the back support 100 as described above, rest against a floor and support the collapsible toy kitchen 10 in the expanded position, such as shown in FIGS. 1 through 4.

The side walls 500 and 600 may each be foldable. The side walls 500 and 600 may each be pivotably connected to one or more other parts of the collapsible toy kitchen 10. In an embodiment, the side walls 500 and 600 are each pivotably connected to both the back support 100 and front wall 400. Referring to just the side wall 500 for simplicity but with the understanding that the side wall 600 is similarly constructed and connected, the side wall 500 may be pivotably connected to the brace 130, or another part of the back support 100, and front wall 400 by hinges 502 and 504, respectively. The hinges 502 and 504 may be positioned so they are shown when the collapsible toy kitchen 10 is in the expanded position as in FIG. 1, or may be disposed on the portion of the side wall 500 facing the interior compartment described above so as to be hidden. The side wall 500 may include two side wall portions 506 and 508 pivotably connected to each other, such as by hinges 510 about which the two side wall portions 506 and 508 can fold. The side wall portions 506 and 508 may be approximately the same size so the side wall 500 can evenly fold. As shown, for example, in FIG. 9 and described below, by being pivotably connected to the back support 100 and front wall 400 and including two side wall portions 506 and 508 pivotably connected to each other, the side wall 500 may pivot to fold the side wall 500 to contribute to collapsing the collapsible toy kitchen 10 by moving the front wall 400 towards the back support 100.

Figure 4:
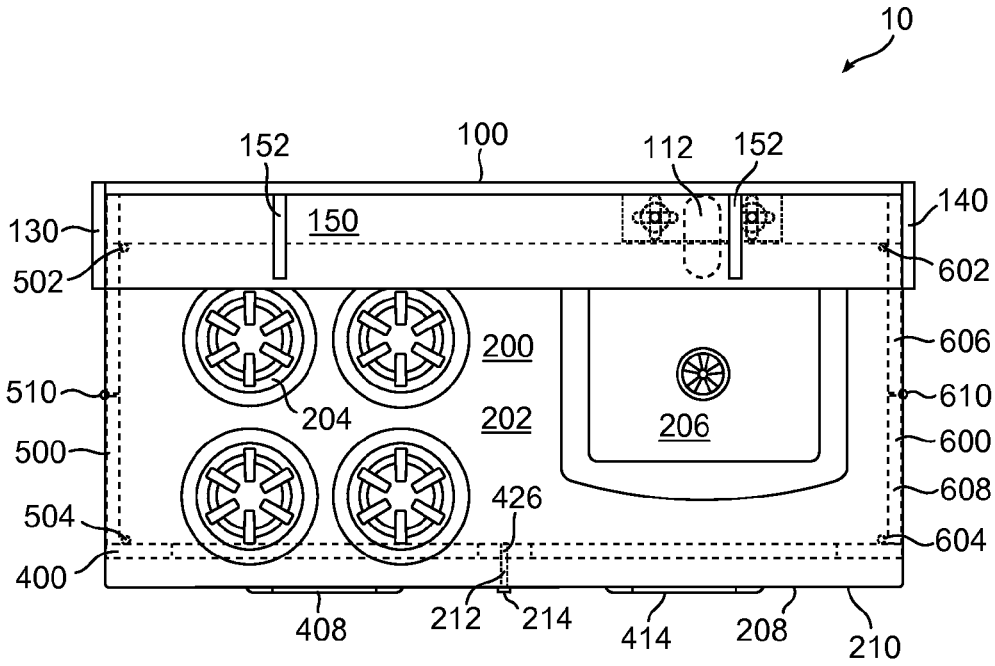
FIG. 4 illustrates a top view of a collapsible toy kitchen, in accordance with one embodiment.
Figure 7:
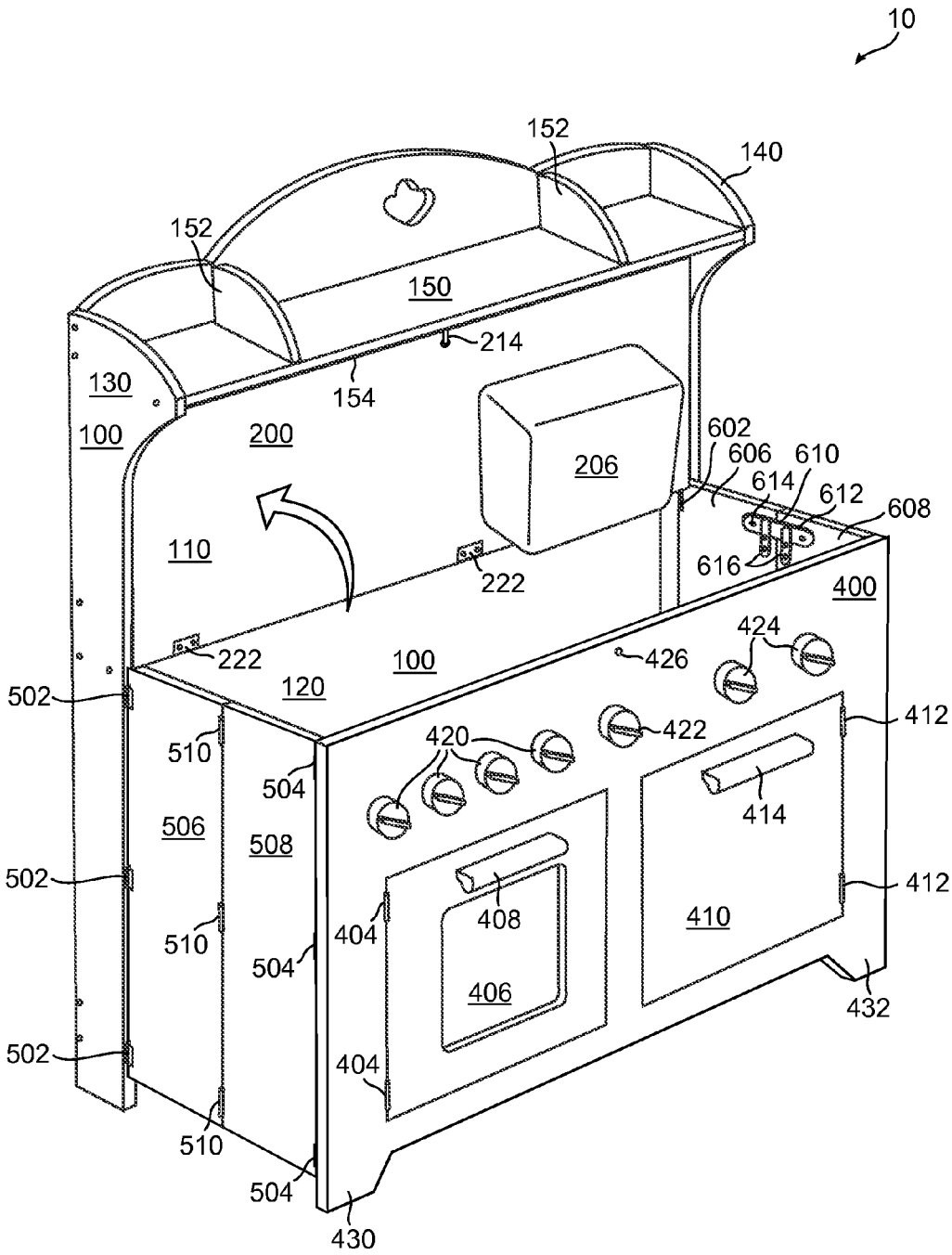
FIG. 7 illustrates a perspective view of the collapsible toy kitchen with the kitchen counter in the collapsed position, in accordance with one embodiment.

As mentioned above, the side wall 600 may be similarly constructed and connected as is the side wall 500. Thus, the side wall 600 may be pivotably connected to the back support 100, such as to the brace 140, and the front wall 400, such as by hinges similar to the hinges 502 and 504 associated with the side wall 500. One such hinge similar to one of the hinges 502 is shown in FIG. 7 (and FIGS. 4 and 11 by hidden lines) as hinge 602, and another hinge similar to hinge 504 is shown by hidden lines as 604 in FIGS. 4 and 11. Likewise, the side wall 600 may also include two side wall portions, shown as 606 and 608 in FIG. 7, that are pivotably connected to each other, such as by hinges like the hinges 510 pivotably connecting the side wall portions 506 and 508 of the side wall 500. One such hinge 610 is shown in FIG. 4 (and in FIG. 11 by hidden lines).

In an embodiment, the side walls 500 and 600 may each be locked so as to prevent the side walls 500 and 600 from folding when not desired and thus keep the side walls 500 and 600 in an expanded position, such as shown in FIG. 1 (for side wall 500) and FIG. 7. Now referring just to side wall 600 for simplicity but with the understanding that a similar construction may be attached to the side wall 500, a latch 610 may be attached to the side wall 600 to lock the two side wall portions 606 and 608 in the expanded position. As so expanded, the side wall portions 606 and 608 may be prevented from being in their folded positions of FIG. 9.

In an embodiment, the latch 610 includes a bar 612 attached to the side wall 600, such as by pivotable connection such as a pin 614 attached to the sidewall portion 606. The latch 610 may also include a catch 616, which may include one or more elements attached cantilevered to the side wall 600. In one embodiment, the catch 616 includes two such elements, one attached to the side wall portion 606 and the other attached to the side wall portion 608, though the catch may be another type of catch in another embodiment. As so cantilevered, the bar 612 may be pivoted to rest between each element of the catch 616 and the side wall 600. In that position, the bar 612 may extend between the side wall portions 606 and 608 to keep the side wall 600 in the expanded position, preventing the side wall portions 606 and 608 from pivoting about the pivotable connection that connects each other (akin to the hinges 510 that pivotably connect the side wall portions 506 and 508 of the side wall 500 to each other) and moving in the direction of the interior compartment described herein.

As described above, the collapsible toy kitchen 10 may be collapsed from its expanded position to its collapsed position in which it takes up less space, which may facilitate storage. FIGS. 6 through 9 show perspective views of the collapsible toy kitchen 10 in various positions between the expanded and collapsed position.

Figure 6:
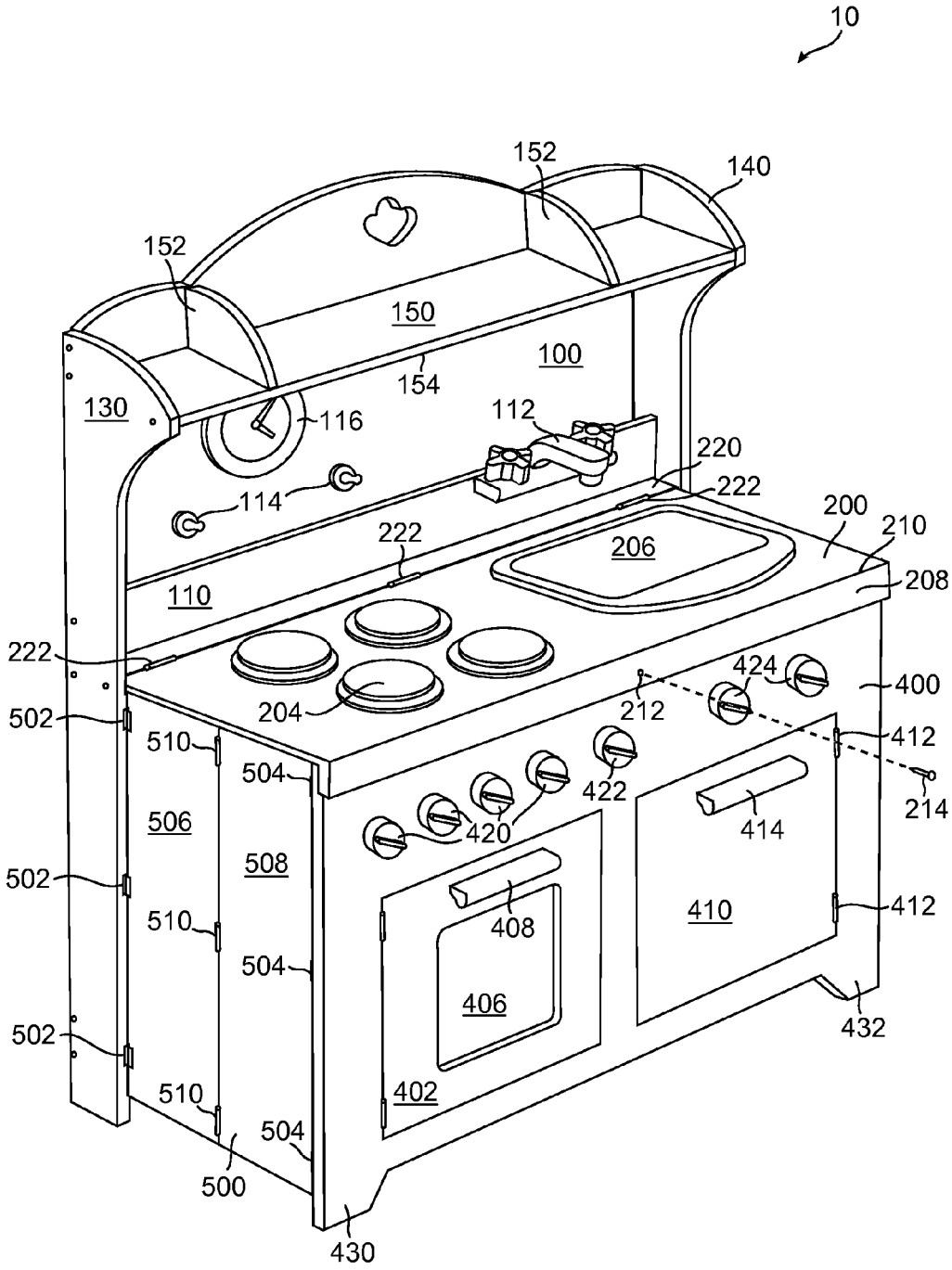
FIG. 6 illustrates a perspective view of a collapsible toy kitchen in its expanded position, but with the fastener removed, in accordance with one embodiment.

FIG. 6 illustrates a perspective view of the collapsible toy kitchen 10 in its expanded position, but with the fastener 214 removed, in accordance with one embodiment. As removed, the kitchen counter 200 may be pivoted away from the front wall 400. As shown in the perspective view of FIG. 7, the kitchen counter 200 may be pivoted, in the direction shown by the arrow, to the collapsed position with its lip 208 against or close to the shelf 150, or its position when the collapsible toy kitchen 10 is collapsed. As so positioned, the aperture 212 of the lip 208 may be aligned with the aperture 156 of the shelf 150, and the fastener 214 may be extended at least partially through both the apertures 156 and 212 to secure the kitchen counter 200 to the shelf 150. As described herein, in one embodiment, the fastener 214 and the aperture 156 of the shelf 150 is at least partially threaded and the fastener 214 can be extended through the aperture 212 and screwed into the aperture 212 of the lip 208 to hold the kitchen counter 200 in the upright, collapsed position.

As described herein, the base 300 may also be pivoted to its collapsed position. FIG. 8*a* illustrates a perspective view of the collapsible toy kitchen 10 with the kitchen counter 200 in the collapsed position and the base 300 also in its collapsed position, pivoted up towards the back support 100. In an embodiment, the base 300 may be thin or made a light material relative to those of one or more of the lower back wall 120, front wall 400, and side walls 500 and 600 such that when the collapsible toy kitchen 10 is fully collapsed as shown in FIG. 9 described below, the weight of the base 300 will not force the side walls 500 and 600 and front wall 400 back towards their expanded positions.

Figure 8B:
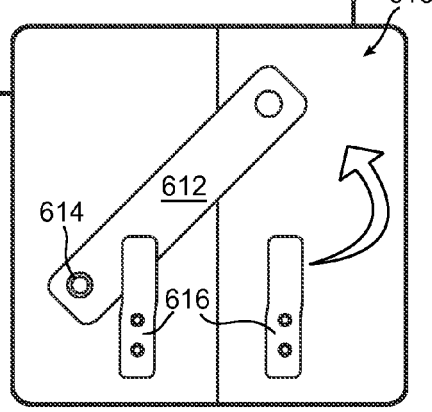
FIG. 8*b* illustrates a perspective view of a close-up of the latch shown in FIG. 8*a* with the bar pivoted partway away from the catch.

After the base 300 has been moved to its collapsed position, the side walls 500 and 600 may be folded and thereby moved to their collapsed positions. To fold the side walls 500 and 600, the bars (e.g., bar 612 for side wall 600) of the latches (e.g., latch 610 for side wall 600) attached thereto may be pivoted away from the resting position against their catches (e.g., catch 616 for side wall 600) and the side wall 600. FIG. 8*b* shows a close-up of the latch 610 of FIG. 8*a* with its bar 612 pivoted partway, in the direction of the arrow, away from its locking position shown in FIG. 7. FIG. 8*a* shows the latch 610 with the bar 612 pivoted out of the locking position. With the bar 612 in out of the locking position (along with the corresponding bar for the latch attached to the side wall 500 out of the locking position), the side walls 500 and 600 may be folded, such as by pushing the side walls 500 and 600 towards inward, and thus toward the interior compartment described herein. Folding the side walls 500 and 600 may move the front wall 400 close to the back support 100.

Figure 9:
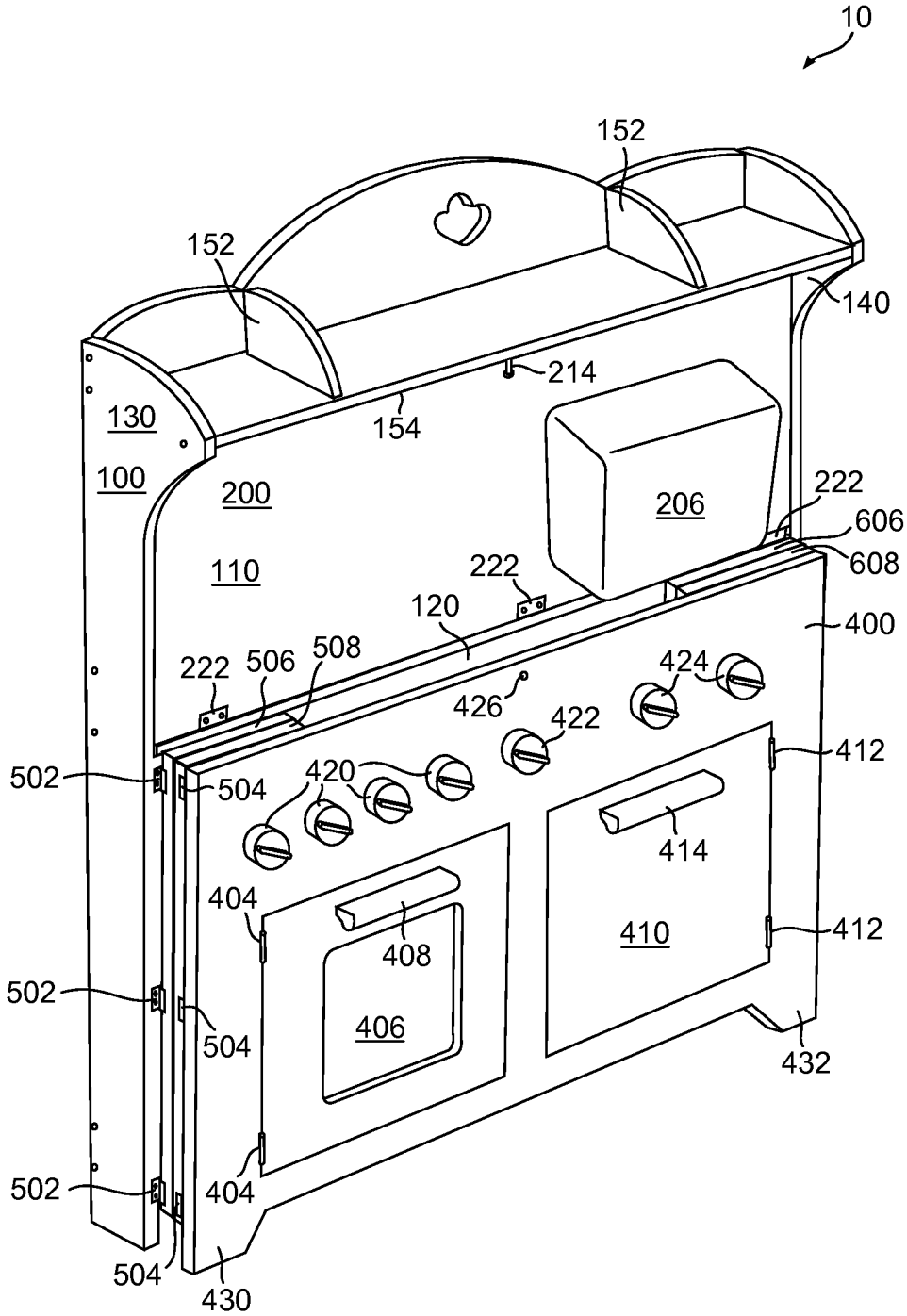
FIG. 9 illustrates a perspective view of the collapsible toy kitchen in the fully collapsed position, in accordance with one embodiment.

FIG. 9 illustrates a perspective view of the collapsible toy kitchen 10 in the fully collapsed position, in accordance with one embodiment. In this position, the kitchen counter 200 has been pivoted to an upright position and secured to the shelf 150 as described with respect to FIG. 7, the base 300 has been pivoted up to an upright position as described with respect to FIG. 8*a*, the latches (e.g., latch 610 for side wall 600) for the side walls 500 and 600 have been pivoted out of their locking positions as described with respect to FIGS. 8*a* and 8*b*, and then the side walls 500 and 600 have been folded, and thus their side wall portions 506, 508 and 606, 608 have been pivoted together about their pivotable connection (e.g., for side wall 500, side wall portions 506 and 508 pivoted about hinges 510 toward each other until close or in contact).

Figure 3:
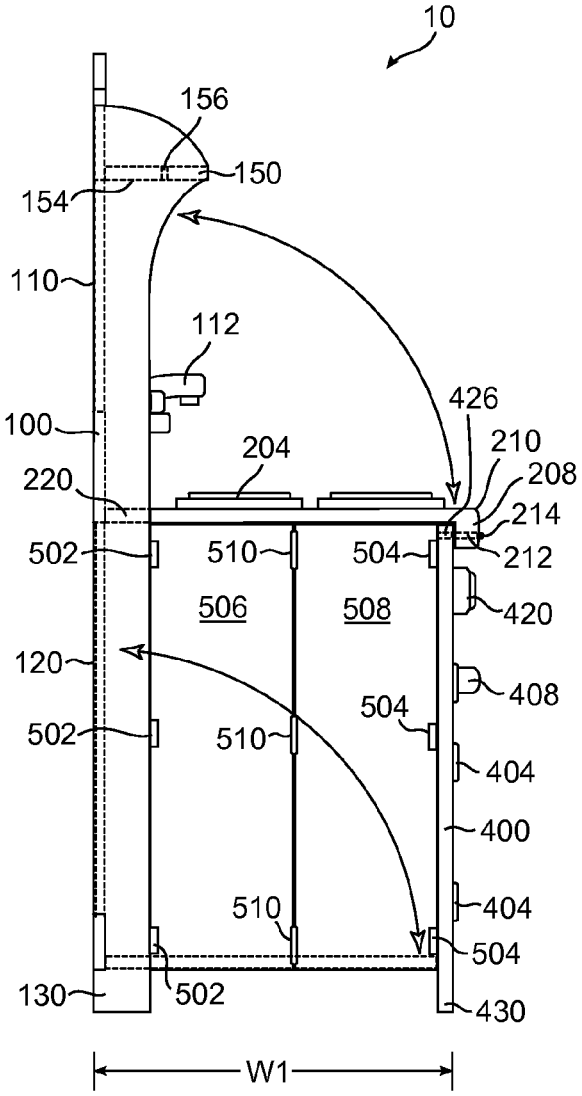
FIG. 3 illustrates a side view of a collapsible toy kitchen, in accordance with one embodiment.

In the fully collapsed position, the collapsible toy kitchen 10 may have a significantly lesser width than in the expanded position. FIG. 10 illustrates a side view of the collapsible toy kitchen 10 in the fully collapsed position, and shows its comparably lesser width as compared to the collapsible toy kitchen 10 in its expanded width shown in FIG. 3. In one embodiment, the width W1 of the collapsible toy kitchen 10 in the expanded position shown in FIG. 3 is approximately 15.25 inches, whereas its width W2 in the fully collapsed position shown in FIG. 10 is approximately 6 inches. In other embodiments, these dimensions may be different.

FIG. 10 also shows, in the fully collapsed position, that the faucet 112 and sink 206 are positioned such that the faucet 112 extends at least partially into the sink 206. Thus, the faucet 112 and sink 206 are sized and positioned such that the faucet 112 does not impede the range of rotation of the kitchen counter 200.

Figure 11:
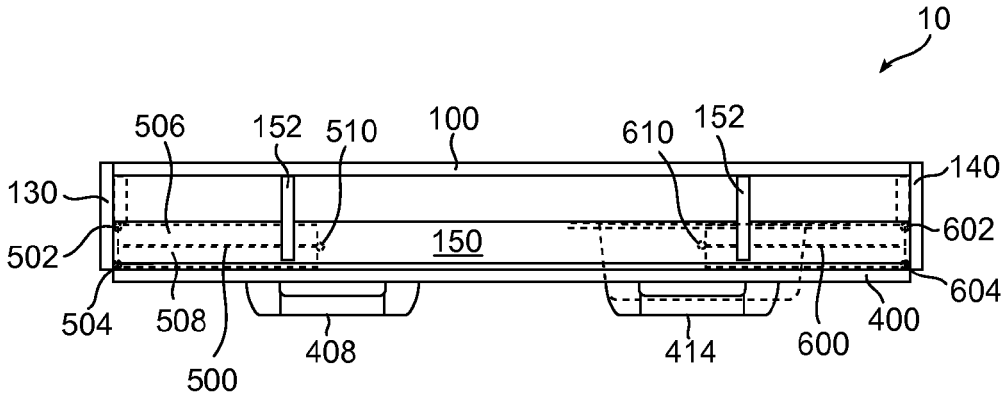
FIG. 11 illustrates a top view of the collapsible toy kitchen in the fully collapsed position, in accordance with one embodiment.

FIG. 11 illustrates a top view of the collapsible toy kitchen in the fully collapsed position, in accordance with one embodiment, further showing the comparably lesser width of the collapsible toy kitchen 10 in that position as compared to the expanded position of, e.g., FIG. 4.

The collapsible toy kitchen 10 may be made of various materials. For example, the back support 100, kitchen counter 200, base 300, front wall 400 and side walls 500 and 600 may be mostly made of medium density fiberboard or other wood. The faucet 112, hooks 114, clock 116, sink 206, window 406 for the oven door 402, handles 408 and 414, and controls 420, 422, and 424 may be made of plastic. Other materials may be alternatively or additionally be used for the aforementioned parts and other parts of any of the embodiments of the collapsible toy kitchen 10 herein.

While specific embodiments of the invention have been described in detail, it should be appreciated by those skilled in the art that various modifications and alternations could be developed in light of the overall teachings of the disclosure. For example, in various embodiments, the pivotable connection of the kitchen counter 200 and/or base 300 to the back support 100 may be or include a connection to the braces 130 and 140 or any other part of the back support 100, and the kitchen counter 200 may be securable to any part of the back support 100 with the fastener 214. Accordingly, the particular arrangements, apparatuses, systems, and methods disclosed are meant to be illustrative only and not limiting as to the scope of the invention.

What is claimed is:

1. A collapsible toy kitchen, comprising:

a back support comprising a backsplash;

a kitchen counter comprising a countertop and a range, the kitchen counter pivotably connected to the back support such that the kitchen counter is pivotable to an upright position;

a base, the base pivotably connected to the back support;

two side walls that are each foldable; and a fastener, the kitchen counter securable in the upright position to the back support with the fastener.

2. The collapsible toy kitchen of claim 1, further comprising a front wall, the kitchen counter securable to the front wall with the fastener.

3. The collapsible toy kitchen of claim 2, the back support further comprising a shelf, the kitchen counter securable in the upright position to the back support with the fastener by being securable in the upright position to the shelf with the fastener.

4. The collapsible toy kitchen of claim 3, the shelf comprising an underside, the underside comprising an aperture to receive the fastener to secure the kitchen counter in the upright position to the shelf.

5. The collapsible toy kitchen of claim 3, the aperture extending completely through the shelf.

6. The collapsible toy kitchen of claim 2, the kitchen counter further comprising a front edge and a lip, the lip extending from the front edge and including an aperture through which the fastener is to extend to secure the kitchen counter to the front wall.

7. The collapsible toy kitchen of claim 6, the front wall including an aperture through which the fastener is to at least partially extend to secure the kitchen counter to the front wall.

8. The collapsible toy kitchen of claim 6, the back support further comprising a shelf extending from the backsplash, the fastener to extend through the aperture to secure the kitchen counter in the upright position to the back support by securing the kitchen counter to the shelf.

9. The collapsible toy kitchen of claim 2, each of the two side walls pivotably connected to both the back support and the front wall.

10. The collapsible toy kitchen of claim 9, the back support further comprising two braces, each of the two side walls pivotably connected to the back support by being pivotably connected to the two braces.

11. The collapsible toy kitchen of claim 9, each of the two side walls comprising two side wall portions pivotably connected to each other.

12. The collapsible toy kitchen of claim 11, further comprising, for each of the two side walls, a latch attached to the side wall to lock the two side wall portions in an expanded position.

13. The collapsible toy kitchen of claim 1, further comprising a sink extending through the countertop.

14. The collapsible toy kitchen of claim 13, further comprising a faucet secured to the backsplash in a position such that when the kitchen counter is secured to the back support with the fastener, the faucet extends at least partially into the sink.

15. A collapsible toy kitchen, comprising:

a back support comprising a backsplash;

a kitchen counter comprising a countertop and a lip, the lip comprising a first aperture, the kitchen counter pivotably connected to the back support such that the kitchen counter is pivotable to an upright position;

a shelf extending from the back support and comprising a second aperture; and a fastener to secure the kitchen counter in the upright position to the shelf by extending at least partially through both the first aperture and the second aperture.

16. The collapsible toy kitchen of claim 15, further comprising a front wall comprising a third aperture, the fastener further to secure the kitchen counter to the front wall by extending through the first aperture and at least partially through the third aperture.

17. The collapsible toy kitchen of claim 15, further comprising two side walls, the two side walls foldable.

18. The collapsible toy kitchen of claim 15, further comprising a base pivotably connected to the back support.

19. The collapsible toy kitchen of claim 15, the kitchen counter further comprising a sink, the sink extending through the countertop, the collapsible toy kitchen further comprising a faucet extending from the back support such that when the fastener secures the kitchen counter to the shelf, the faucet extends at least partially into the sink.

20. A collapsible toy kitchen, comprising:

a back support comprising two braces and a backsplash;

a kitchen counter comprising a countertop, a range, and a sink, the kitchen counter pivotably connected to the back support such that the kitchen counter is pivotable to an upright position;

a base pivotably connected to the back support;

a front wall;

an oven door including a window, the oven door connected to the front wall;

two side walls pivotably connected to both the back support and the front wall, each of the two side walls comprising two side wall portions pivotably connected to each other; and a shelf extending from the back support, the kitchen counter securable in the upright position to the shelf.

* * * * *